US005179820A

United States Patent [19]

van der Werff

[11] Patent Number: 5,179,820

[45] Date of Patent: Jan. 19, 1993

[54] METHOD AND APPARATUS FOR REMOVING CONTENTS FROM AN ENVELOPE

[75] Inventor: Jeichienus A. van der Werff, Montfoort, Netherlands

[73] Assignee: Hadewe B. V., Drachten, Netherlands

[21] Appl. No.: 707,789

[22] Filed: May 30, 1991

[30] Foreign Application Priority Data

May 30, 1990 [NL] Netherlands ..... 9001237

[51] Int. Cl.[5] ..... B43M 7/02; B65B 43/26

[52] U.S. Cl. ..... 53/492; 53/381.5

[58] Field of Search ..... 53/492, 381.5, 381.1, 53/381.2, 381.3

[56] References Cited

U.S. PATENT DOCUMENTS 3,739,543 6/1973 Harris ..... 53/381 R X
3,884,010 5/1975 Bardo et al. ..... 53/53 X
3,888,069 6/1975 Pierce et al. ..... 53/381.5

FOREIGN PATENT DOCUMENTS 346891 2/1905 France .
2428529 1/1980 France .
WO88/01543 3/1988 World Int. Prop. O. .

*Primary Examiner*—James F. Coan
*Attorney, Agent, or Firm*—Burns, Doane, Swecker & Mathis

[57] ABSTRACT

An envelope to be opened and emptied has a first and a second panel (12, 13) at least partially severed along three folding edges and interconnected along a fourth folding edge. A portion of the first panel is moved relatively to the second panel in the direction of the fourth folding edge and pivoted about the fourth folding edge. According to the invention a portion of the envelope adjoining the substantially severed folding edge opposite the fourth folding edge is curled and subsequently the edge of the second panel opposite the fourth folding edge is withheld by a retainer from following the movement of said portion of said first panel. Envelopes of which the front and the back panel are not completely severed along three folding edges can mechanically and reliably be opened and emptied.

27 Claims, 2 Drawing Sheets

METHOD AND APPARATUS FOR REMOVING CONTENTS FROM AN ENVELOPE

BACKGROUND OF THE INVENTION

The invention relates to a method for removing contents from an envelope having a first and a second panel at least partially severed along three folding edges and interconnected along a fourth folding edge, comprising the steps of sliding a portion of the first panel relatively to the second panel in the direction of the fourth folding edge and pivoting said portion about the fourth folding edge.

The invention further relates to an apparatus for removing contents from an envelope comprising a station for facilitating access to the contents of an envelope substantially severed along three of its folding edges, said station comprising a transport track and friction surfaces disposed on opposite sides of the transport track and facing each other, of which friction surfaces at least one can be pressed towards the other friction surface and can be moved relatively to the other surface in at least one direction substantially parallel to the transport track.

A method and an apparatus as described above are known from French patent 346 891. After the first panel is pivoted about the fourth folding edge, the contents of the envelope can easily be removed from the envelope for example by picking the contents up manually or, as proposed in the aforementioned document, by sliding the contents over subsequently the second and the first panel until the contents are separated from the envelope.

Although in the course of time better high friction materials than the rubber and sanding cloth used according to the aforementioned document have become available, the processing of envelopes of which the front and back panel were not completely severed along the three folding edges remained a major problem. This problem is of particular importance because to avoid damage to the contents of the envelope, as little material as possible is taken of the three folding edges. This in turn brings about the effect that at dented sections of the edges, the front and the back panel are not completely separated. In practice such dents are, for example, caused by rubber bands wrapped around stacks of postal items to be delivered in the same postal district.

Furthermore, it would be advantageous not to separate the panels entirely along the three edges to ensure firstly that even if the contents are damaged during severing the three edges, the contents are not split into two ore more pieces but merely perforated; and secondly that no material is taken off the edges of the edges of the envelope. The latter material would have to be removed separately.

SUMMARY OF THE INVENTION

Accordingly it is an object of the invention to provide a method which makes it possible to reliably remove contents from an envelope severed along three of its folding edges even if the front and the back panel of the envelope are not completely severed along said three edges.

This object is achieved in accordance with the invention if in the method described above a portion of the envelope adjoining the substantially severed folding edge opposite the fourth folding edge is curled and that from the moment where a certain degree of curling is reached, the edge of the second panel opposite the fourth folding edge is at least locally witheld from following the movement of said portion of said first panel.

If one or more remaining connection are present in the area opposite the fourth folding edge, due to that connection between the first and the second panel and the displacement of the first panel relative to the second panel the portion of the envelope adjoining the substantially severed folding edge opposite the fourth folding edge is automatically curled.

When subsequently the second panel is withheld or restrained from following the first panel, the two panels are pulled apart causing the rupture of the remaining connections along the three not completely severed folding edges. Pulling apart the two panels after a part of the envelope is curled is advantageous because the edge of the second panel of the envelope will be at the outside of the curl and will partially extend from the first panel. These extending portions can be withheld from following the first panel thereby exerting a force pulling the two panels apart very near to the remaining connections between said panels and very effective for rupturing these remaining connections.

The invention is further embodied in an apparatus for carrying out the method according to the invention.

This object can be achieved in accordance with the invention by providing an apparatus of the type described above with a restraint spaced from the transport track and the friction surfaces, the friction surface on the same side of the transport track as the restraint being displaceable away from that restraint.

When the friction surface on the same side of the transport track as the restraint is moved away from the restraint, a first envelope panel is entrained by that friction surface, whereas a second panel of the envelope is held in place by the opposite friction surface. If the panels are not completely separated along the three severed folding edges, the movement of the first panel relative to the second panel and the connections along the severed folding edges will cause the envelope portion adjacent to the restaint to curl toward the restraint until the edge of the second panel abuts the restraint and is withheld or restrained by the restraint from following the first panel.

DESCRIPTION OF THE PREFERRED EMBODIMENT

Figure 1:
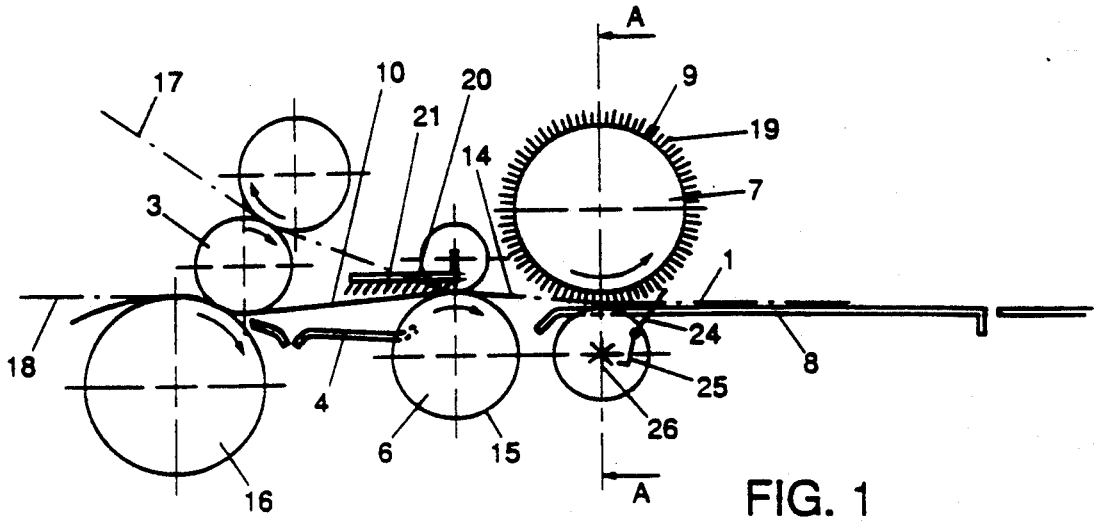
FIG. 1 shows a schematic sectional side view of a preferred embodiment of the apparatus according to the invention in a state before an envelope is supplied to be processed.
Figure 2:
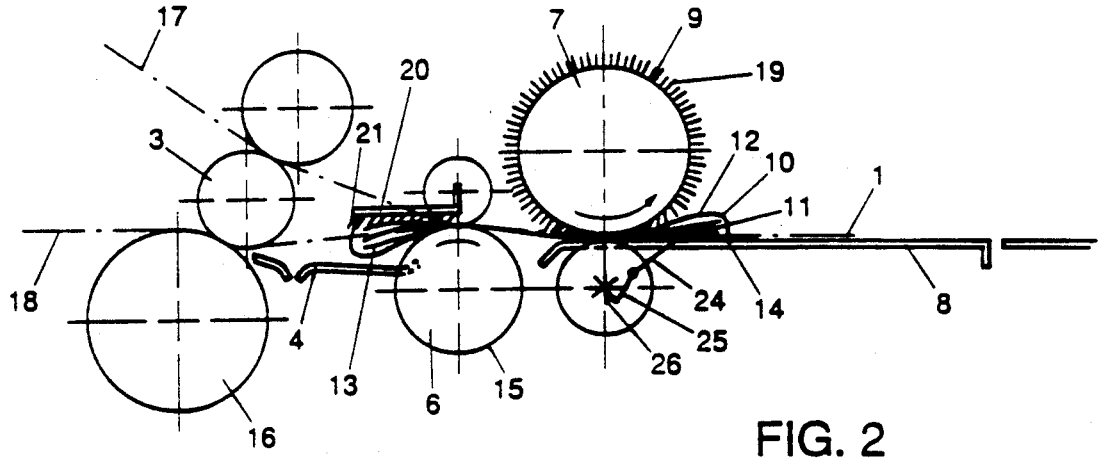
FIG. 2 shows a view according to FIG. 1, the apparatus being in a state where a panel of the envelope is slid relatively to the other panel.
Figure 3:
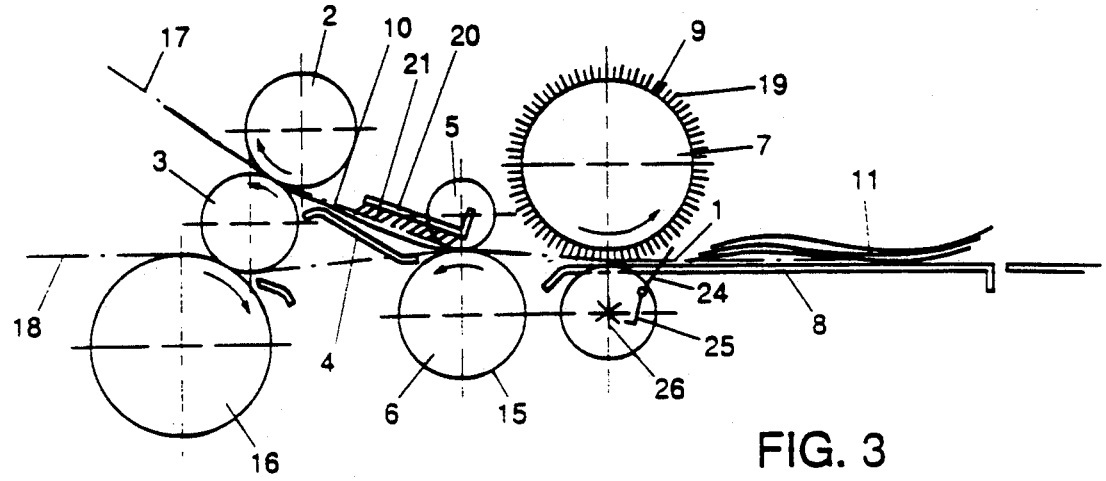
FIG. 3 shows a view according to FIG. 1, the apparatus being in a state where the contents of the envelope are slid over the panels.

In the FIGS. 1-3 an envelope 10 only partially severed along three of its folding edges is generally indicated by the reference numeral 10. The envelope comprises a first panel 12 and a second panel 13 interconnected along a fold 14, and contains a contents 11. As shown in FIG. 2, a portion of the first panel 12 of the envelope 10 is slid relatively to the second panel 13 in the direction of the fold 14. This movement of the first panel 12 is continued until it pivots about the fold 14.

The contents 11 can be slid in the same direction as the direction of the sliding movement of the first panel 12 for removing these contents 11 from the envelope 10.

For the first panel 12 and optionally the contents 11 to be slid relative to the second panel 13, an endless surface 9, such as the outer surface of an endless belt or a roller 7, may be provided for engaging the first panel 12 and a fixed surface 8 may be provided for engaging the second panel 13.

The preferred embodiment of a station for carrying out the method according to the invention with an envelope 10 having contents 11 is shown in three successive operational stages (FIGS. 1-3).

The station comprises a transport track 1 including a guiding plate 4, a guiding roller 5, a transport roller 6, a friction roller 7 and a retaining surface 8. The friction roller 7 and the retaining surface 8 form friction surfaces arranged on opposite sides of the transport track 1 and facing each other. When the envelope is supplied (FIG. 1) the friction roller 7 is in a lifted position relative to the retaining surface 8 so that the envelope can be brought in a position between the friction roller 7 and the retaining surface 8 by rotating the transport roller 6 and the guiding roller 5. The friction roller 7 and the retaining surface 8 are then pressed towards each other for exerting a pressure to the envelope (FIG. 2) and moved relative to each other parallel to the transport track 1. According to the present embodiment this is achieved by retaining the retaining surface 8 relative to the position of the transport roller 6 and the guiding roller 5 and urging the friction roller 7 towards the retaining surface 8 and rotating it in such a way that portions of the circumference 9 of the friction roller 7 facing the retaining surface 8 move away from the guiding roller 5 and the transport roller 6. Preferably the transport roller 6 is blocked before the friction roller 7 is driven and the guiding roller 5 rotates freely with the displacements of the panel 12, 13 of the envelope 10 which is in engagement with roller 5.

The envelope 11 is clamped between the friction roller 7 and the retaining surface 8, and a portion of the first panel 12, against which the friction roller 7 is pressed, is slid relative to the second panel 13 in the direction of the fold 14. When the first panel 12 is slid out of the pressing area, it is pivoted about the fold 14 by the friction roller 7 so as to unfold. When the first panel 12 is unfolded the contents 11 are accessible. Due to the continued action of the friction roller 7 the contents 11 will also be slid over the first panel 12 in the direction of the free edge opposite the fold 14 preferably until the contents 11 is fully separated from the envelope (FIG. 3).

As shown in FIG. 3, the friction roller 7 is lifted off the retaining surface 8 after the contents 11 of the envelope 10 have come clear of roller 7. Then the transport roller 6 is put into operation and rotated in such a direction that the portions of its circumference 15 facing the guiding roller 5 are moved away from the retaining surface 8. The guiding plate 4 according to the embodiment shown forms a switch connecting the envelope supply track 18 and an exit track 17 for emptied envelopes 10 with the transport track 1. In FIG. 3 the guiding plate 4 is extended upwards so as to guide the envelope 10 supplied by the transport roller 6 to the beginning of the exit track 17, which beginning is formed by oppositely arranged portions of an intermediate roller 3 and a removal roller 2.

The exit track 17 is arranged above the supply track 18. This offers the advantage that the envelope can be removed along the upper side of the apparatus, which facilitates visual inspection of the envelope.

Since the envelope 10 is removed in a direction which is substantially opposite to the direction of the sliding movement of the first panel 12 and the contents 11 are slid in the direction of that sliding movement, automatically a full separation of the envelope from its contents is obtained and maintained. The envelope can be transported away from the operator to a discharge container.

Concentrically with the friction roller 7 sweeping means are provided which can be rotated along the retaining surface 8 for sweeping along that surface. Thus separation of the contents 11 from the envelope 10 is supported and removal in part or as a whole of the contents 11 along with the envelope 10 is counteracted. When the roller 7 has been lifted off the envelope 10 (see FIG. 3), the contents 11 are swept off the envelope 10 when the envelope 10 is being removed by rotating the sweeping means 19. By restraining the sweeping means 19 from rotation relative to the friction roller 7, their sweeping action can be controlled by continuing the rotation of the friction roller after it has been lifted off the envelope 10.

The sweeping means 19 further support the pivotal movement of the first panel 12 about the fourth folding edge 14 after it has come clear of the friction roller 7.

Spaced from the transport track 1 and the friction roller 7 is a restraint 20. The friction roller 7 and the restraint 20 are disposed on the same side of the transport track 1. In operation, the friction roller 7 is rotated in a direction in which the consecutive portions of the circumference 9 of the friction roller 7 facing the retaining surface 8 move away from the restraint 20.

When in the area of the envelope 10 opposite the fourth folding edge 14 connections between the first and the second panel 12 and 13 are present, a portion of that envelope 10 adjoining the edges opposite the fourth folding edge 14 will curl up. From the moment where a certain degree of curling is reached the edge of the second panel 13 opposite the fourth folding edge 14 will at least locally be prevented or restrained from following the sliding movement of the aforementioned portion of the first panel 12 (see FIG. 2). As a result the first and the second panel 12 and 13 will be drawn from each other along the edges opposite the fourth folding edge 14. This in turn brings about the effect that the connections between the first and the second panel 12 and 13 are ruptured. The envelope 10 can now be unfolded so as to make the contents 11 accessible in spite of the presence of connections between these panels opposite the fourth folding edge 14. Remaining connections between the first an the second panel 12 and 13 in other areas of the envelope, except of course the connection along the fourth folding edge 14, are ruptured due to the sliding motion of the first panel 12 relative to the second panel 13 independent of the effect of the retainer 20 on a curled portion of the envelope 10 opposite the fourth folding edge 14.

As shown in FIG. 2, the transport track 1 is substantially straight from the restraint 20 to the area between the friction roller 7 and the retaining surface 8. Opposite the restraint 20 a free space is provided. This free space permits the envelope to curl even if its contents 11 comprise a stiff layer such as a piece of cardboard or a hard plastic card. The portion of the second panel 13, adjoining its edge opposite the fourth folding edge 14 curls in the free space opposite the restraint 20 by bulging off from the contents 11.

The restraint may be designed as a surface of a material having a high coefficient of friction relative to paper, such as rubber, so that the force exerted by the restraint on the edge of the second panel opposite the fold is obtained by friction. The restraint may also comprise hooking means whose free ends are directed towards the transport track, so that the force directed away from the first panel is exerted by the restraint on the separation edge of the second panel opposite the fold on account of the fact that that separation edge is hooked behind at least a part of the restraint.

According to the preferred embodiment shown, the restraint 20 comprises a short-haired brush 21 so that the separation edge of the second panel 13 is reliably restrained substantially directly upon checking the restraint 20, regardless of which part of the restraint 20 is touches by the edge of the second panel 13 opposite the fourth folding edge 14.

The hairs which form the brush 21 can exert a very great and advantageously distributed force on the separation edge of the second panel 13 opposite the fourth folding edge 14. The residual connections between the first and the second panel can thus be torn reliably, while laceration of the severing edge is avoided.

The switch formed by the guiding plate 4 is disposed on the same side of the friction surfaces 7, 8 as the restraint 20. Thus, as explained hereinabove, the envelope 10 can readily be removed in a direction opposite the direction of discharge of the contents 11. A further advantage is that the guiding plate 4 can be coupled with the restraint 20 so that the plate 4 as shown in FIG. 3, can be pivoted upwards away from transport track 1 for guiding an emptied envelope 10 which is to be discharged via the exit track 17 and driven by the intermediate roller 3 and a removal roller 2 arranged oppositely.

Figure 4:
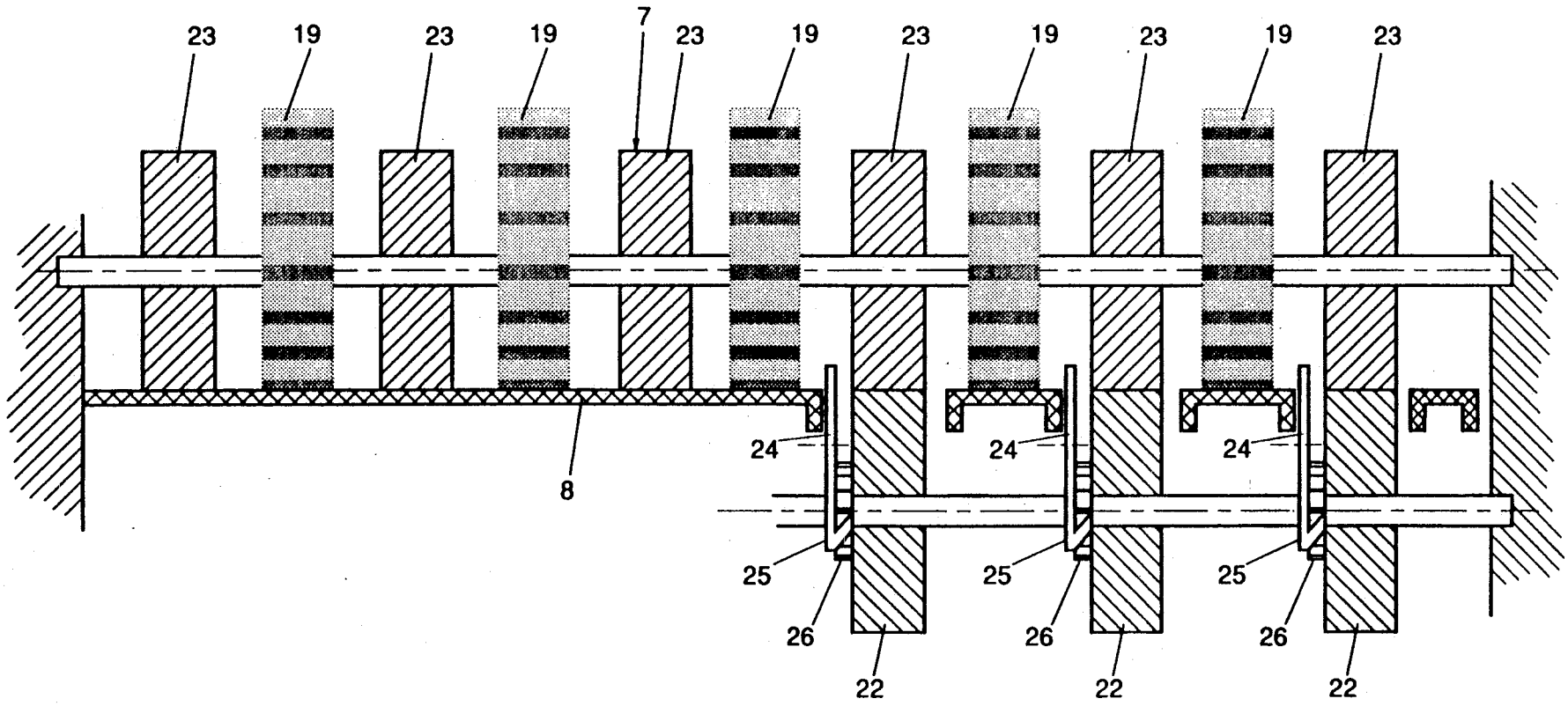
FIG. 4 shows a sectional front view taken on the line A—A in FIG. 1.

As shown in FIG. 4, the retaining surface 8 comprises three idling wheels 22 which can be blocked, depending on the width of an envelope supplied between the friction roller 7 and the retaining surface 8. The friction roller 7 comprises a plurality of coaxial friction wheels 23, each of the idling wheels 22 allowing one of the friction wheels 23 to be pressed against it. When the envelope to be emptied is of such width that it extends to a certain idling wheel 22, this wheel 22 is blocked so that it cooperates with the retaining surface 8 in sliding the second panel 13 relative to the first panel 12. When no part of an envelope is disposed between a certain friction wheel 23 and the idling wheel 22 arranged opposite to it, that wheel 22 remains freely rotatable, so that it can freely rotate driven by the friction wheel 23 arranged opposite to it. The present embodiment avoids excessive friction and wear of the friction wheels 23 and the retaining surface 8 during the processing of relatively narrow postal items.

To control the blocking of the idling wheels 22, at each wheel 22 a sensor may be provided to be operated by an envelope located between the friction surfaces and capable of blocking the corresponding idling wheel 22.

In the present preferred embodiment the sensor comprises a double arm 24 coupled with a blocking member 25. The blocking member 25 is adapted to engage a winged wheel 26 connected concentrically with the idling wheel 22. Such a sensor is of simple construction, reliable, and can be manufactured at low cost.

When the processing of a postal item has passed the stage shown in FIG. 2 and the first panel 12, and the contents 11 between the friction roller 7 and the retaining surface 8 have been removed so that only the second panel 13 of the envelope 10 is left between the friction roller 7 and the retaining surface 8, the pressure of the friction roller 7 towards the retaining surface 8 is to be interrupted. As discussed hereinabove, this is effected in the present embodiment by shifting the friction roller 7 away from the retaining surface 8.

To determine the moment at which the pressure exerted by the friction roller 7 is to be interrupted, the apparatus may comprise a sensor (not shown) for generating a signal representing the resistance the friction roller 7 is subject to, the sensor being coupled for interrupting the operation of the friction roller 7 when the resistance sustained by the friction roller 7 exceeds a predetermined level. According to an advantageous embodiment, the sensor is incorporated in a chain tensioner engaging a driving part of a chain for driving the friction roller 7 and comprising means for generating the signal when the chain tensioner passes a predetermined position.

According to the presently preferred embodiment of the invention the means for determining the moment at which the operation of the friction roller 7 is to be interrupted comprises a timer for actuating the means for shifting the friction roller 7 away from the retaining surface 8. The timer can be set for actuating the shifting means when a fixed time interval has passed after the friction roller 7 has been shifted towards the retaining surface 8. This is particularly advantageous when the edge of the envelope 10 opposite the fourth folding edge 14 is in each case transported up to a fixed position opposite the restraint 20 before the friction roller 7 is shifted towards the retaining surface 8. The timer can also be connected to start the fixed time interval upon interruption of the rotation of a detection roller (not shown) arranged between the friction roller 7 and the retaining surface 20. This brings about the advantage that, independently of the size of the contents 11 and of the envelope 10, the friction roller 7 can be shifted away from the retaining surface 8 at a constant period of time before the passage of the last trailing edge of the contents 11 and therefore, if the rotating speed of the friction roller is maintained constant, at a constant distance of the last trailing edge of the contents 11.

In conjunction with the time controlled shift of the friction roller 7 away from the retaining surface 8, the sweeping means 19 offer the advantage that the friction roller can be shifted away from the retaining surface 8 relatively early. The sweeping means 19 can readily produce the relatively small force which is necessary for driving the contents 11 over that envelope 10 after the first panel of the envelope 10 has pivoted about the fold 14.

The sweeping means are particularly suitable for sweeping the contents 11 over the envelope 10 if they are composed of flaps of flexible material having a high coefficient of friction with paper, such as rubber. In unloaded condition these flaps preferably extend radially outwardly of the friction wheels 23, the sweeping means 19 being arranged between each pair of the friction wheels 23 viewed in the direction of the axis of the friction roller 7.

I claim:

1. A method for removing contents from an envelope having a first and a second panel at least partially severed along three folding edges and interconnected along a fourth folding edge, comprising the steps of:

sliding a portion of the first panel relative to the second panel in a direction of the fourth folding edge in such a manner that a portion of the envelope adjoining a substantially severed folding edge opposite the fourth folding edge curls;

restraining an edge of the second panel opposite the fourth folding edge from following a sliding movement of said portion of said first panel after a certain degree of curling is reached; and pivoting said portion of the first panel about the fourth folding edge.

2. A method according to claim 1, further comprising the step of sliding contents in the envelope in the same direction as the direction of the sliding movement of said portion of said first panel.

3. A method according to claim 2, further comprising the step of removing the contents in a direction substantially opposite to the direction of the sliding movement of said portion of said first panel.

4. A method according to claim 1, wherein when said degree of curling is reached, the edge of the second panel opposite to the fourth folding edge meets with a restraint which exerts a force on said edge of the second panel, said force being directed away from the first panel.

5. A method according to claim 4, wherein the force exerted by the restraint on the edge of the second panel opposite the fourth folding edge is exerted by friction.

6. A method according to claim 4, wherein the force exerted by the restraint on the edge of the second panel opposite the fourth folding edge is exerted by hooks behind which said edge of the second panel is hooked.

7. A method according to claim 1, further comprising the step of sliding the contents in the same direction as the direction of the sliding movement of said portion of said first panel.

8. A method according to claim 2, further comprising the step of removing the contents in a direction substantially opposite to the direction of the sliding movement of said portion of said first panel.

9. An apparatus comprising a station for facilitating access to the contents of an envelope substantially severed along three of its folding edges, said station comprising a transport track, friction surfaces on opposite sides of the transport track and facing each other, of which friction surfaces at least one can be pressed towards the other friction surface and can be moved relatively to the other surface in at least one direction substantially parallel to the transport track, and a restraint spaced from the transport track and the friction surfaces, the friction surface on the same side of the transport track as the restraint being displaceable away from that restraint.

10. Apparatus according to claim 9, wherein the restraint comprises hooking means whose free ends are pointed to the transport track.

11. Apparatus according to claim 9, wherein the restraint comprises a short-haired brush.

12. Apparatus according to claim 9, wherein the transport track includes a switch connecting an envelope supply track and an envelope discharge track for emptied envelopes with the transport track.

13. Apparatus according to claim 12, wherein the switch is arranged on the same side relatively to the friction surfaces as the restraint .

14. Apparatus according to claims 9, wherein at least one of the friction surfaces is a circumferential surface of a friction roller connected to drive means for rotating said roller about its axis.

15. Apparatus according to claim 14, wherein one of the friction surfaces comprises at least one idling wheel which can be blocked, the friction roller disposed opposite to the idling wheel comprising a plurality of coaxial friction wheels at least one of the friction wheels being disposed directly opposite the idling wheel.

16. Apparatus according to claim 15, comprising a sensor for sensing the presence of a part of an envelope between the idling wheel and the friction wheels directly opposite said idling wheel and operative for blocking said idling wheel.

17. Apparatus according to claim 16, wherein the sensor comprises a double pivoting arm acting on a blocking member.

18. Apparatus according to claim 14, including a sensor for detecting the resistance encountered by the friction roller, said sensor being operative for interrupting the driving of the friction roller when said resistance exceeds a predetermined level.

19. Apparatus according to claim 18, wherein the sensor is incorporated in a chain tensioner engaging a driving part of a chain for driving the friction roller and comprising means for generating a signal when the chain tensioner passes a predetermined position.

20. Apparatus according to claim 14, including time controlled means coupled for interrupting the operation of the friction roller after said roller has been in operation for a fixed period of time.

21. Apparatus according to claim 14, including a timer, control means for interrupting the driving of the friction roller and by a detection roller arranged before the friction roller, said detection roller being connected for starting the timer when said detection roller comes to a standstill, the timer being operative actuating the control means for interrupting the operation of the friction rollers when a predetermined period of time has elapsed since the timer is started.

22. Apparatus according to claim 16, wherein the friction roller comprises sweeping means concentric with said friction roller for sweeping along the opposite friction surface.

23. Apparatus according to claim 9, wherein the friction surfaces can be moved apart.

24. Apparatus according to claim 9, wherein the transport track is substantially straight from the restraint to the friction surfaces, a free space being provided opposite the restraint.

25. Apparatus according to claim 9, wherein the restraint comprises a surface having a high coefficient of friction relative to paper.

26. A method for removing contents from an envelope having a first panel and a second panel at least partially severed from said first panel along three folding edges and interconnected to said first panel along a fourth folding edge, comprising the steps of:

sliding a portion of the first panel relative to the second panel in a direction of the fourth folding edge;

restraining an edge of the second panel which is opposite said fourth folding edge from following a sliding movement of said portion of the first panel after a certain degree of curling is reached;

exerting a frictional force on the edge of the second panel opposite said fourth folding edge with a restraint. said frictional force being directed away from said first panel: and pivoting said portion of the first panel about the fourth folding edge.

27. A method according to claim 26, wherein the force exerted by the restraint on the edge of the second panel opposite the fourth folding edge is exerted by hooks behind which said edge of the second panel is hooked.

* * * * *